US007178202B2

(12) United States Patent
Hirtsiefer et al.

(10) Patent No.: US 7,178,202 B2
(45) Date of Patent: Feb. 20, 2007

(54) DOOR SETTING DEVICE

(75) Inventors: Artur Hirtsiefer, Neunkirchen-Seelscheid (DE); Christian Reineking, Bitzen (DE); Jürgen Schnell, Lohmar (DE)

(73) Assignee: Huwil-Werke GmbH MobelschloB-und Beschlagfabriken, Ruppichteroth (DE)

( * ) Notice: Subject to any disclaimer, the term of this patent is extended or adjusted under 35 U.S.C. 154(b) by 0 days.

(21) Appl. No.: 10/515,835

(22) PCT Filed: May 21, 2003

(86) PCT No.: PCT/EP03/05317

§ 371 (c)(1),
(2), (4) Date: Mar. 22, 2005

(87) PCT Pub. No.: WO03/097973

PCT Pub. Date: Nov. 27, 2003

(65) Prior Publication Data

US 2005/0218383 A1 Oct. 6, 2005

(30) Foreign Application Priority Data

May 22, 2002 (DE) ..... 102 23 026

(51) Int. Cl.
*E05D 3/06* (2006.01)

(52) U.S. Cl. ..... 16/366; 16/286; 16/289

(58) Field of Classification Search ..... 16/366, 16/370, 371, 286–289; 49/254, 255, 246; 296/37.7; 312/322, 323, 325; 74/89.18
See application file for complete search history.

(56) References Cited

U.S. PATENT DOCUMENTS

| | | | | |
|---|---|---|---|---|
| 2,161,323 | A * | 6/1939 | Stephenson | 312/266 |
| 3,088,727 | A * | 5/1963 | Pelagatti | 74/89.18 |
| 5,904,411 | A * | 5/1999 | Hayakawa | 312/319.2 |
| 2001/0039762 | A1* | 11/2001 | Giovannetti | 49/246 |

FOREIGN PATENT DOCUMENTS

| | | |
|---|---|---|
| DE | 2518942 | 4/1975 |
| DE | 27 57 230 | 7/1979 |
| DE | 94 00 568.0 | 4/1994 |
| EP | 0 044 081 A1 | 7/1981 |
| EP | 1 148 200 A2 | 4/2001 |
| EP | 1148200 A2 * | 10/2001 |

* cited by examiner

*Primary Examiner*—Chuck Y. Mah
(74) *Attorney, Agent, or Firm*—Sughrue Mion, PLLC

(57) ABSTRACT

Disclosed is a lid-positioning device for a cabinet, comprising an actuating arm (10) which is fixed to a side wall (3) of a cabinet carcass (1) so as to be pivotable around a first axis of actuation (13) between an open position and a closed position while being fixed to a lid (8) so as to be pivotable around a second axis of actuation (16), a control arm (11) which is fixed to the side wall (3) of the cabinet carcass (1) so as to be pivotable around a first control axis (14) that is located parallel to the first axis of actuation (13) while being fixed to the lid (8) so as to be pivotable around a second control axis (17) that is located parallel to the second axis of actuation (16). In order to be able to displace the lid (8) in a parallel manner or swivel said lid (8) above the cabinet carcass (1), the lid (8) being held in any random position, actuating means (19) impinge the actuation arm (10) with a specific force across at least a first part of the swiveling path thereof, said force being selected in every position such that the lid (8) can be held in any random position.

11 Claims, 6 Drawing Sheets

DOOR SETTING DEVICE

The invention relates to a door setting device which allows parallel settings of a door of a cupboard or wherein the door can be pivoted over the body of the cupboard.

Prior art door setting devices of said type comprise a setting arm and a control arm which are each, at one end, fixed at a side wall of a cupboard body so as to be pivotable between an open position and a closed position. At their other ends they are each fixed at a door so as to be pivotable around parallel spaced axes. The setting arm is loaded towards the open position by a gas pressure store or by a pressure spring for example. Via a short pivot path between an intermediate position and the closed position, the setting arm is loaded towards the closed position. Therefore, when opening the door, it is first necessary to overcome a pulling force which ensures that the door is held firmly in the closed position. After the intermediate position has been passed, the door then, on its own, moves into the open position. When closing the door, it is necessary to overcome the force which transfers the door into the open position.

The disadvantage of this embodiment is that the door is always transferred into the open position and that, when closing the door, it is necessary to overcome a relatively high force in order to close the door against the force loading it towards the open position.

It is therefore the object of the present invention to provide a door setting device which allows parallel settings of a door or wherein the door can be pivoted over the body of a cupboard and wherein the door can be held in any position.

In accordance with the invention, the objective is achieved by a door setting device for a cupboard comprising

- a setting arm
  - which can be fixed at a side wall of a cupboard body so as to be pivotable around a first setting axis between an open position and a closed position and
  - which can be fixed at a door so as to be pivotable around a second setting axis,
- a control arm
  - which can be fixed at a side wall of the cupboard body so as to be pivotable around a first control axis between an open position and a closed position, wherein the first control axis is arranged parallel to and at a distance from the first setting axis, and
  - which can be fixed at a door so as to be pivotable around a second control axis, wherein the second control axis is arranged parallel to and at a distance from the second setting axis,
- setting means
  - which force-load the setting arm along at least a first part of its pivot path for the purpose of assuming the open position, and which are designed in such a way that they hold the door in any position.

It is thus ensured that the door can be held in any position. As, additionally, the force for holding the door is calculated to be such that the door cannot move into the open position on its own, the force required for closing the door is lower.

In order to ensure that the force in any position is such that the door is held in any position, the setting arm can comprise a setting contour which is arranged around the first setting axis in the shape of a curve, wherein there is provided a setting slide which can be guided so as to be linearly displaceable and is loaded into contact with the setting contour. The radial distance of the setting contour from the first setting axis in the region of contact between the setting slide and the setting contour decreases towards the open position at least over the first part of the pivot path, starting from an intermediate position of the setting arm, which intermediate position is located between the open position and the closed position.

The setting contour can be adapted to any application, i.e. to any door weight and to any geometry of the articulation of the setting arm and of the control arm.

To ensure that over a short pivot path between an intermediate position and the closed position, the door is not loaded towards the open position, but that there is provided a pulling force which pushes the door into its closed position, the radial distance of the setting contour and the first setting axis in the region of contact between the setting slide and the setting contour increases towards the intermediate position via a second part of the pivot path, starting from the closed position of the setting arm.

Because the friction forces vary as a result of wear and dirt, a sliding contact between the setting slide and the setting contour would also vary considerably. In order to avoid this, the setting slide can be supported against the setting contour by a roller which is rotatably supported at the setting slide.

The setting slide can be loaded against the setting contour by spring means. Satisfactory support of the spring means can be achieved by providing a supporting bearing which is held at a variable distance from the first setting axis and by supporting the spring means against the setting slide on the one hand and against the supporting bearing on the other hand.

In order to hold the supporting bearing at a variable distance from the first setting axis, it is proposed according to a first embodiment that the supporting bearing is supported against a bearing face of an abutment which is rotatably supported around an axis of rotation, wherein, in the circumferential direction, the bearing face comprises a variable distance from the axis of rotation. The bearing face can be worm-shaped for example. In the bearing face, there can additionally be provided indentations in order to achieve defined rotational positions of the abutment.

A preferred embodiment of the door setting device comprises a housing which can be fixed to a side wall of the cupboard body and to which the setting arm is fixed so as to be pivotable around the first setting axis and the control arm around the first control axis.

Furthermore, it is possible to provide a fixing element to which the setting arm can be fixed so as to be pivotable around the second setting axis and to which the control arm can be fixed so as to be pivotable around the second control axis, which fixing element can be fixed to the door.

In order to permit a parallel door setting, the distance between the first setting axis and the first control axis and the distance between the second setting axis and the second control axis are identical, and the distance between the first setting axis and the second setting axis and the distance between the first control axis and the second control axis are identical.

Preferred embodiments will be explained below with reference to the drawings wherein FIG. 1 is a sectional view of a cupboard body with an inventive door setting device, wherein the door is shown in its closed position and wherein parallel setting of the door is possible.

Figure 1:
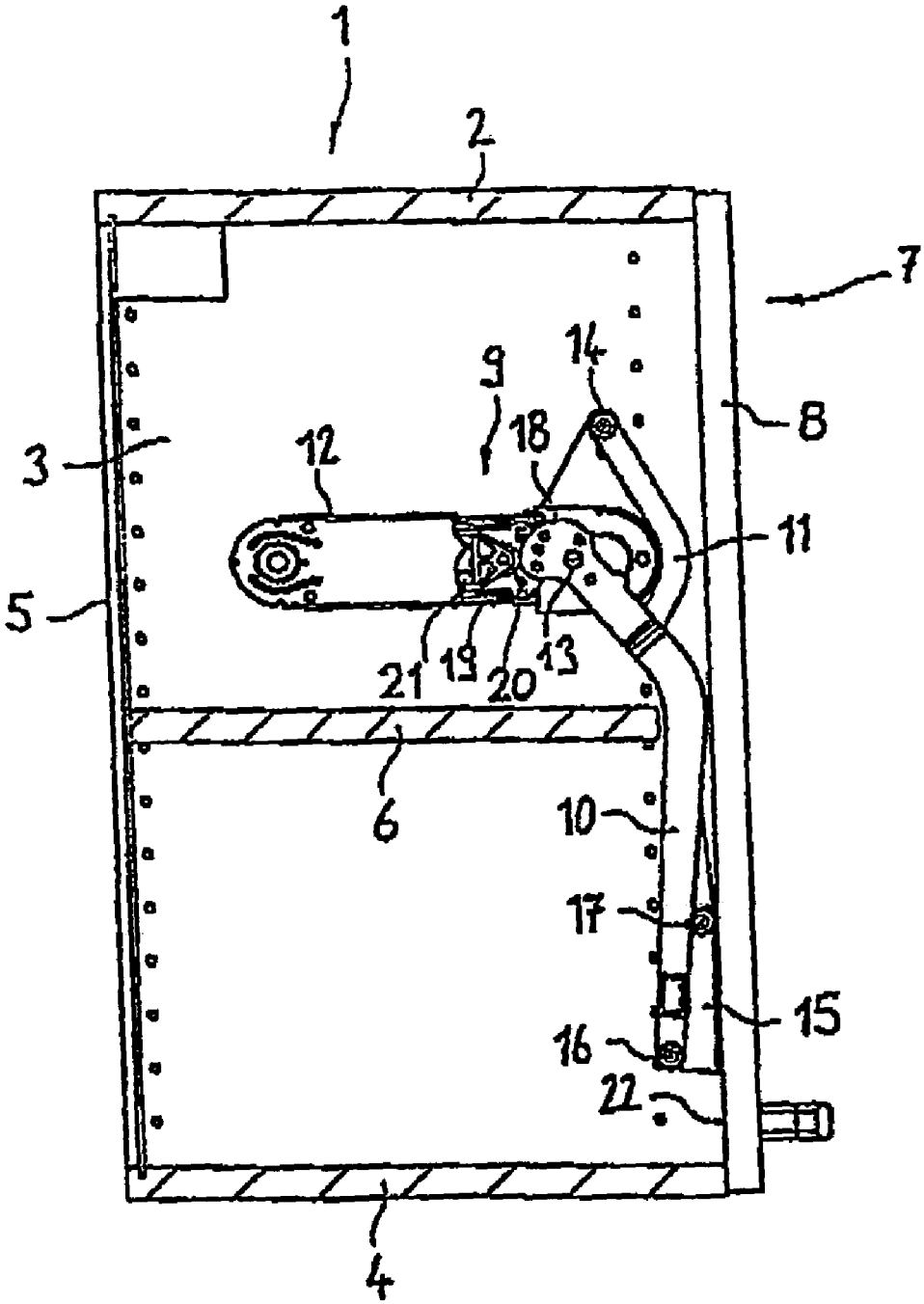
Figure 2:
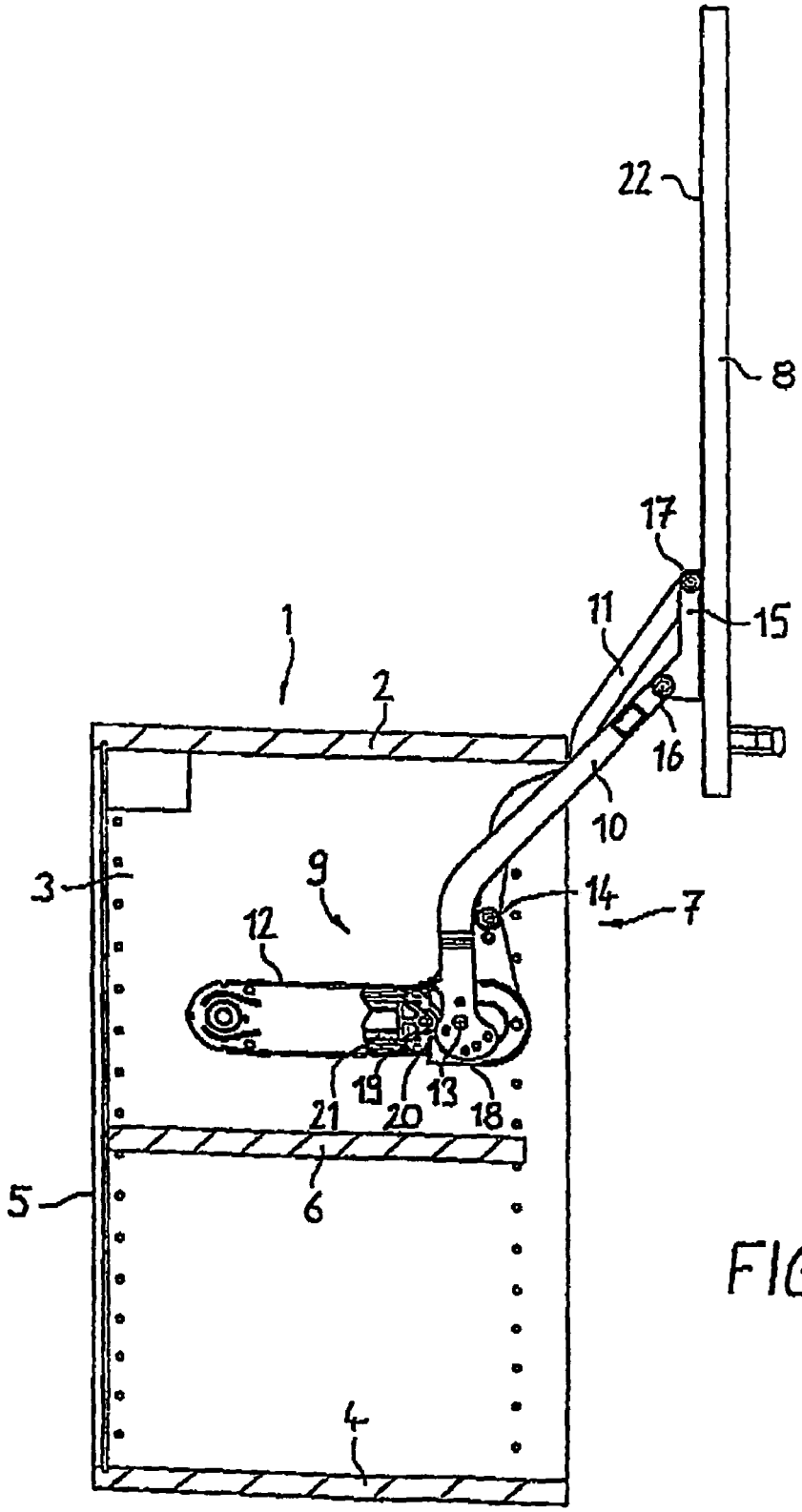
FIG. 2 is a view according to FIG. 1, wherein the door is shown in its open position.

FIGS. 1 and 2 show an inventive door setting device wherein a door of a piece of furniture is designed so as to permit a parallel setting. A cupboard body 1 comprises an upper cover 2, a side wall 3, a cupboard base 4 and a rear wall 5. Inside the cupboard body 1, there is provided a shelf 6. The cupboard body 1 forms an opening 7 which can be closed by a door 8. The door 8 is fixed to the cupboard body 1 so as to be settable by a door setting device 9. The door setting device comprises a setting arm 10 and a control arm 11. The setting arm 10 is fixed to a housing 12 of the door setting device so as to be pivotable around a first setting axis 13. The control arm 11 is fixed to the housing 12 so as to be pivotable around a first control axis 14. The first setting axis 13 and the first control axis 14 extend parallel to, and at a distance from, one another. The housing 12 is firmly fixed to the side wall 3.

At its end arranged so as to be remote from the first setting axis 13, the setting arm 10 is connected to a fixing element 15 so as to be pivotable around a second setting axis 16. The fixing element 15 is fixed to the door 8 at the inner face 22 of same. The second setting axis 16 is arranged so as to extend parallel to, and at a distance from, the first setting axis 13.

The control arm 11 is fixed to the fixing element 15 so as to be pivotable around a second control axis 17, with the second control axis 17 extending parallel to, and at a distance from, the first control axis 14.

The imaginary line between the first setting axis 13 and the second setting axis 16 and that between the first control axis 14 and the second control axis 17 are identical in length and extend parallel relative to one another, so that there is obtained a parallelogram. There is thus achieved a parallel setting movement of the door 8 from the closed position shown in FIG. 1 to the open position shown in FIG. 2.

The control arm 10 comprises a setting contour 18, with a setting slide 19 being radially supported against same by a roller 20. The roller 20 is rotatably fixed to the setting slide 19. The setting slide 19 is loaded by spring means 21 against the setting contour 18.

The radial distance between the setting contour 18 and the first setting axis 13 in the region of contact between the setting slide 19 and the setting contour 18 decreases towards the open position, at least via a first part of the pivot path of the setting arm 10, starting from an intermediate position of the setting arm 10, which intermediate position is located between the open position and the closed position. The way in which the setting contour 18 extends is adjusted equally to the dead weight of the door 8, the setting arm 10 and the control arm 11, so that the door 8 is held in any position. The torque which is generated by the setting slide 19 supported against the setting contour 18 thus changes along the pivot path of the setting arm 10, depending on the amount of torque required for holding the door 8.

Figure 3:
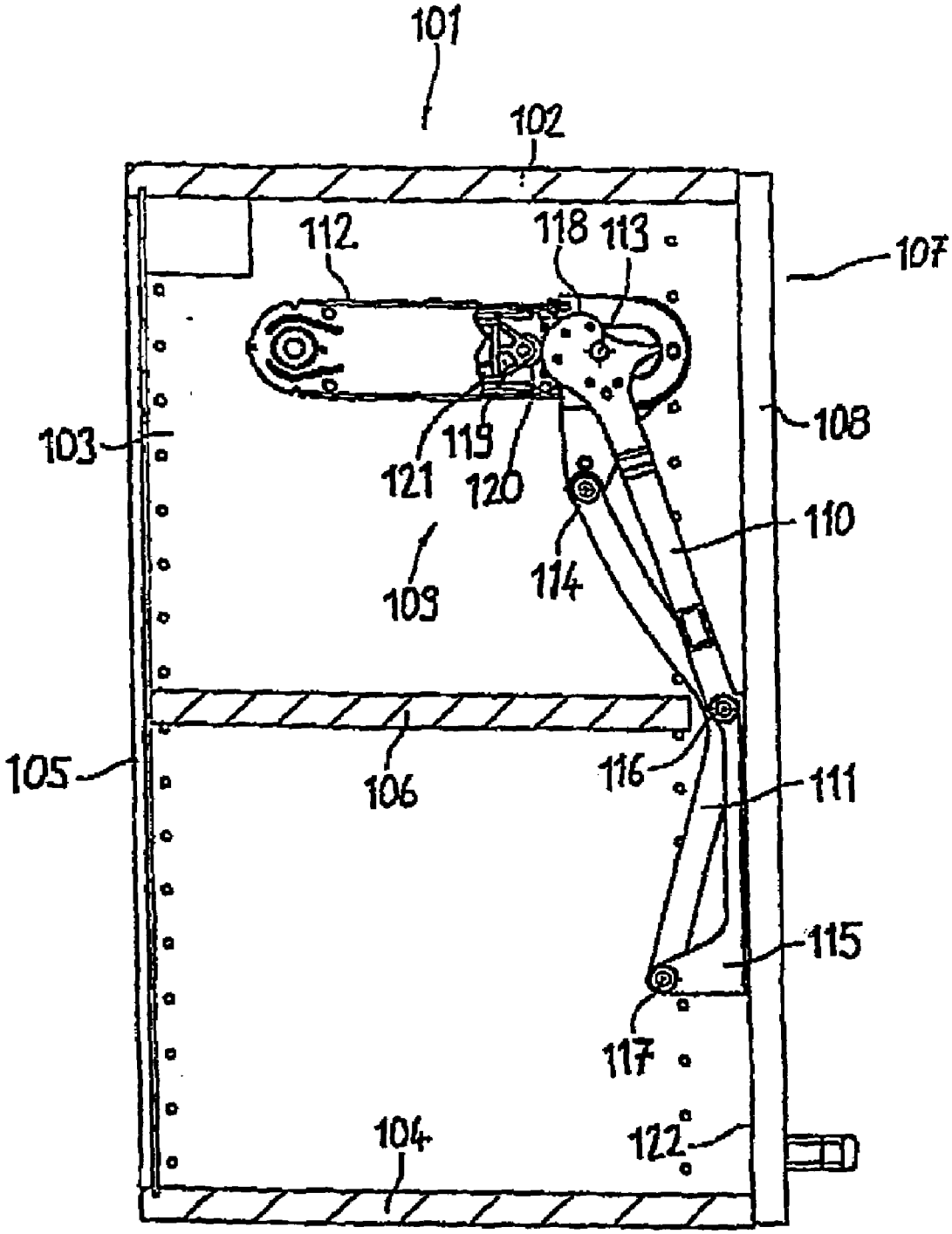
FIG. 3 is a sectional view of a cupboard body with an inventive door setting device, wherein the door is shown in its closed position and wherein it can be seen that the door can be set so as to extend over the cupboard body.
Figure 4:
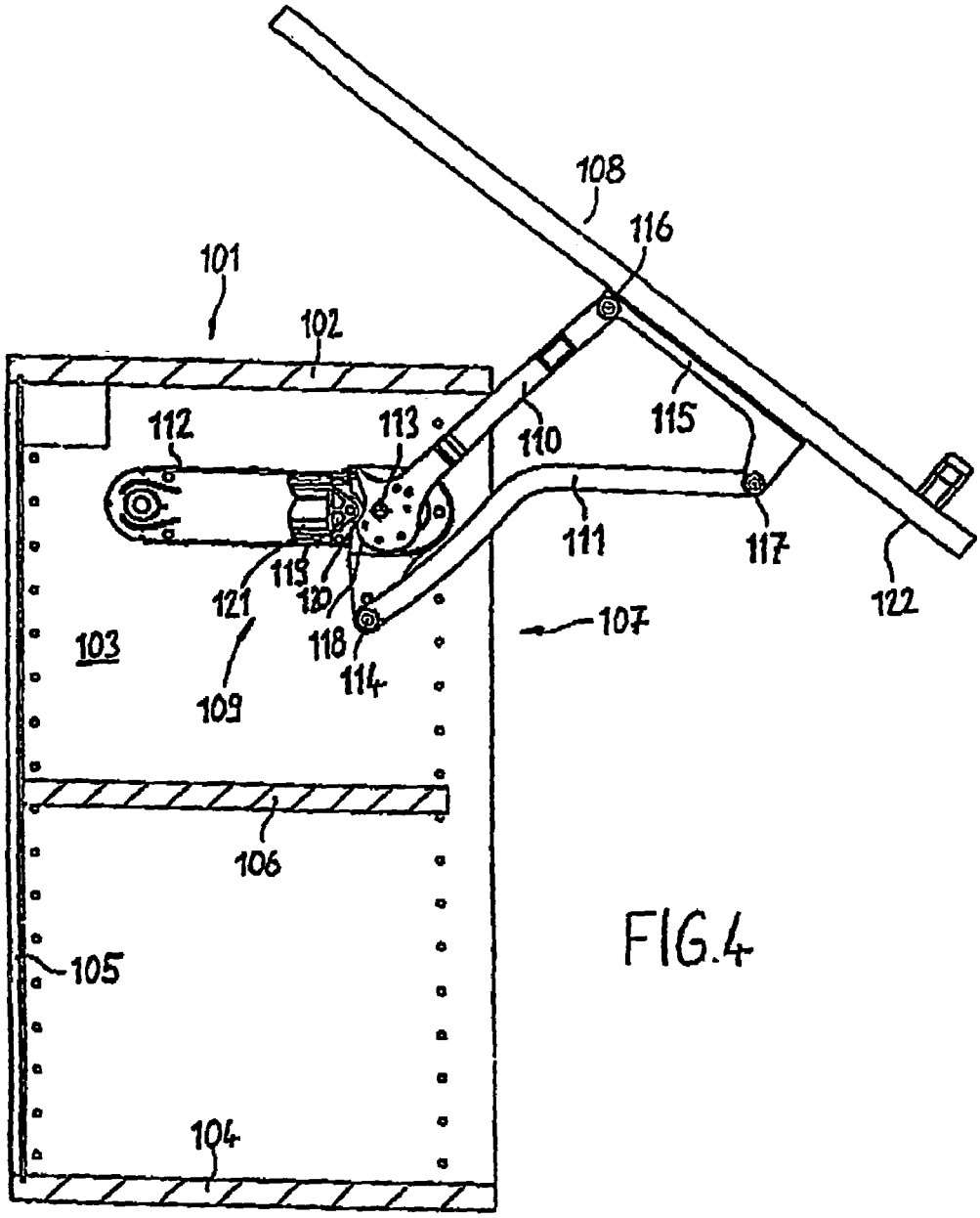
FIG. 4 is a view according to FIG. 3, showing the door in its open position.

FIGS. 3 and 4 show a door setting device which permits the door to be pivoted over a cupboard body. Identical components have been given reference numbers increased by the value of 100 and are described in connection with FIGS. 1 and 2.

In order to ensure that the door 108 pivots over the cupboard body 101, the distance between the first setting axis 113 and the second setting axis 116 is smaller than the distance between the first control axis 114 and the second control axis 117. Furthermore, an imaginary straight line through the two setting axes 113, 116 and a straight line through the two control axes 114, 117 intersect one another above the door setting device 109, with the first control axis 114, furthermore, being arranged below the first setting axis 113, whereas the first control axis 14, in a door setting device according to FIG. 1, is arranged above the first setting axis. An open position as shown in FIG. 4 is thus possible.

Figure 5:
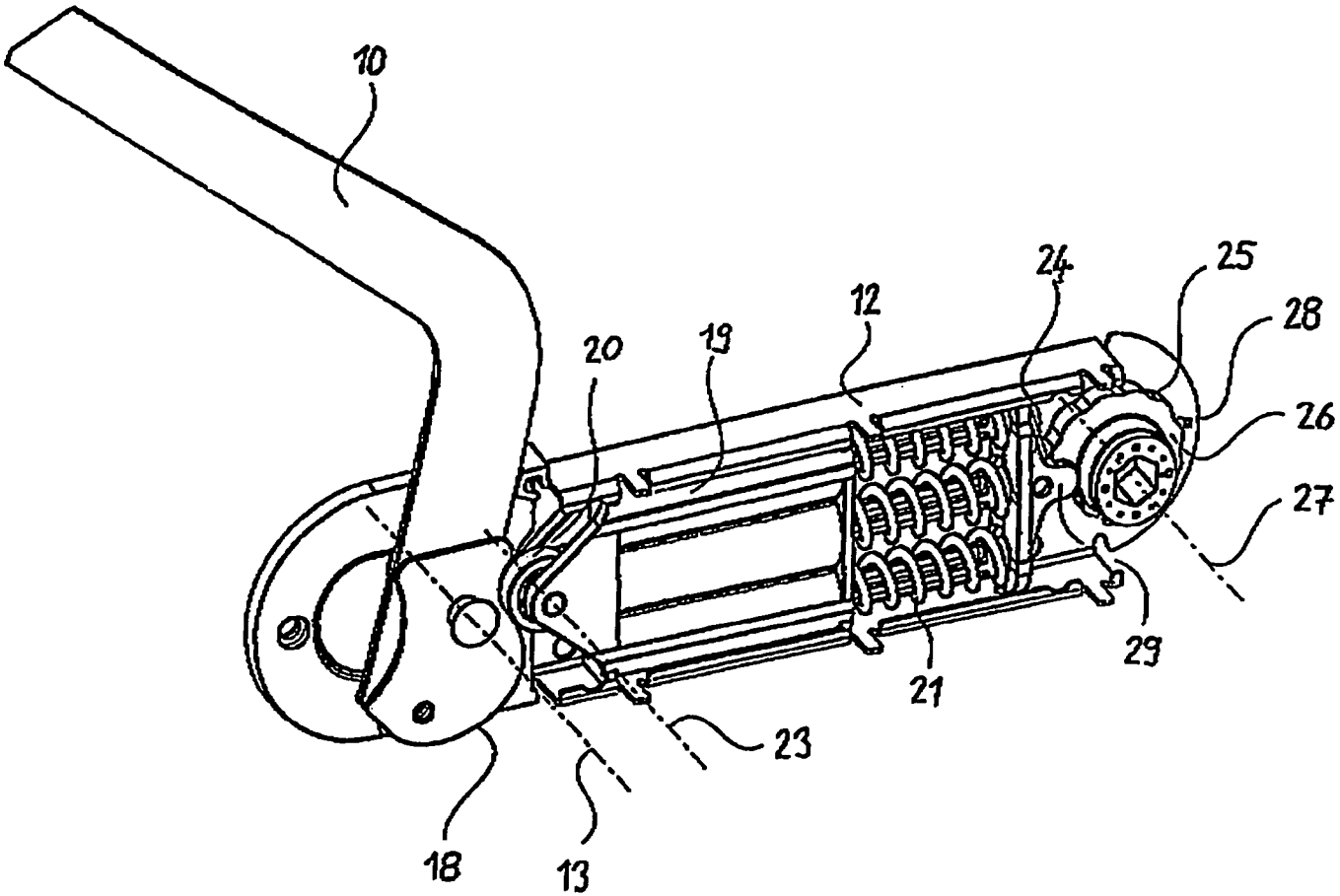
FIG. 5 is a perspective view of a door setting device according to FIG. 1.
Figure 6:
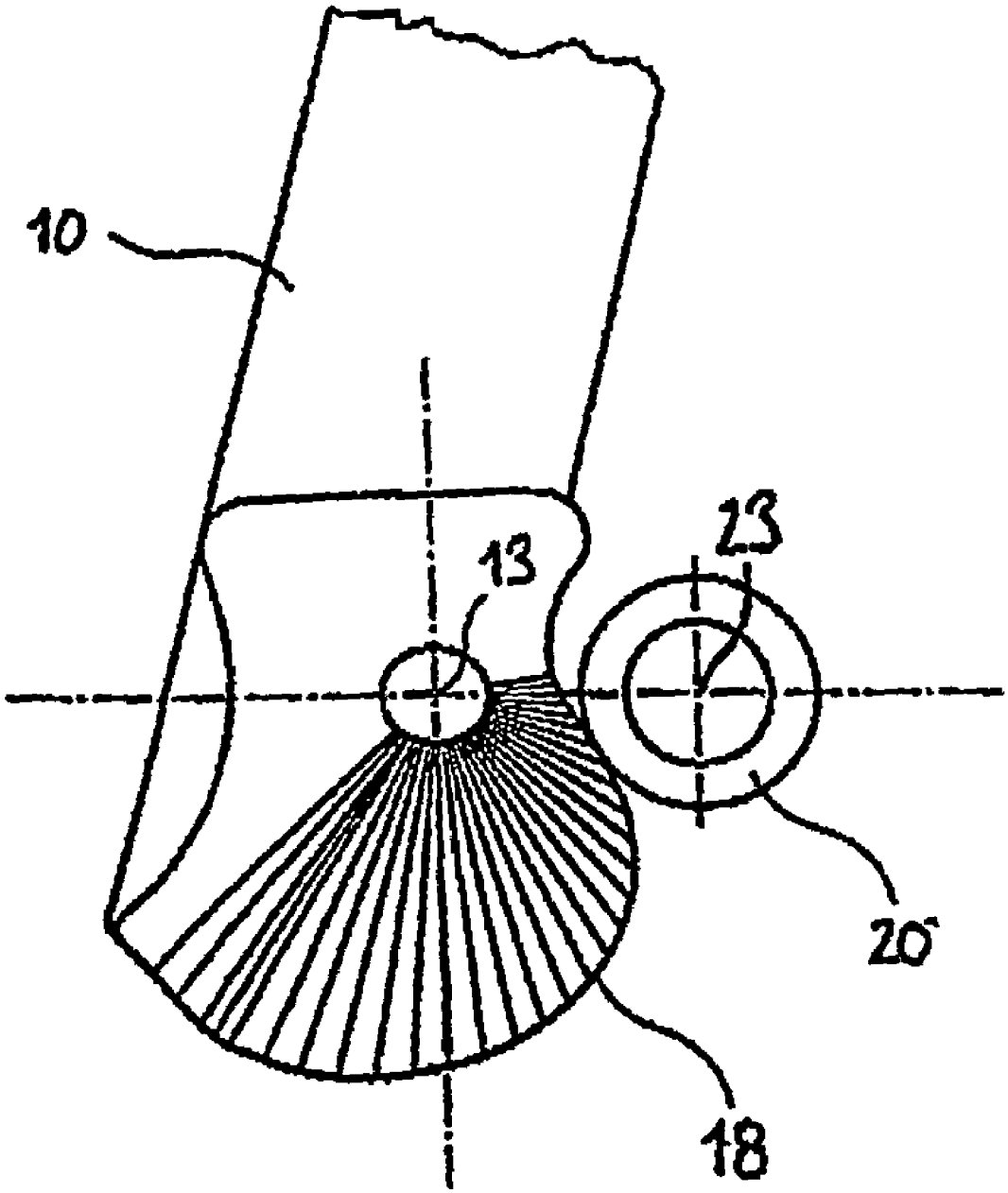
FIG. 6 is a plan view of the setting contour at the setting arm.

Below, the door setting device 9 according to FIGS. 1 and 2 will be described with reference to FIGS. 5 and 6 jointly.

The setting arm 10 is supported in the housing 12 of the door setting device 9 so as to be pivotable around the first setting axis 13, with the housing 12 being firmly connected to the side wall of the cupboard body. The setting arm 10 comprises a setting contour 18 which is shown in the form of a curve extending around the first setting axis 13.

The setting slide 19 is guided in the housing 12 so as to be linearly displaceable. The setting slide 19 comprises a roller 20 which is supported at the setting slide 19 so as to be rotatable around an axis of rotation 23 extending parallel to the first setting axis 13. The roller 20 contacts the setting contour 18 by means of an outer circumferential face. Spring means 21 in the form of pressure springs load the setting slide 19 and thus the roller 20 against the setting contour 18. The spring means 21 are supported against the setting slide 19 on the one hand and against a supporting bearing 24 on the other hand which is linearly displaceably supported in the housing 12. The supporting bearing 24 is supported against a bearing face 25 of an abutment 26, with the abutment 26 being supported in the housing 12 so as to be rotatable around an axis of rotation 27 and with the bearing face 25 being arranged at a variable distance from the axis of rotation 27 of the abutment 26, so that the supporting bearing 24 is held at a variable distance from the first setting axis 13 in the housing 12. The bearing face 25 is worm-shaped and comprises radial indentations which are engaged by an engaging lug 29 of the supporting bearing 24 in order to prevent the abutment 26 from being rotated unintentionally.

The setting contour 18 of the setting arm 10 is designed in such a way that the radial distance between the setting contour 18 and the first setting axis 13 in the region of contact between the setting slide 19, i.e. the roller 20, and the setting contour 18 decreases towards the open position along a pivot path, starting from the intermediate position of the setting arm 10. It is thus ensured that, along the longest angular path, the setting arm 10 is loaded by a force which generates a moment towards the upper position corresponding to the open position of the door 8. Along the angular path starting from the intermediate position to the closed position, the setting contour 18 comprises a flat portion along which the radial distance from the first setting axis 13 decreases. Via said pivot path, there is thus generated a torque which loads the setting arm 10 towards the closed position. The setting contour 18 is designed in such a way that, in every pivot position of the setting arm 10, the torque as generated corresponds to the counter torque generated by the weight force of the door 8 as a whole, so that the door 8 is held in every position between the open position and the intermediate position.

The invention claimed is:

1. A door setting device for a cupboard comprising a setting arm (10, 110)

in which one end of the setting arm can be fixed at a side wall (3, 103) of a cupboard body (1, 101) so as to be pivotable around a first setting axis (13, 113) between an open position and a closed position in which the other end of the setting arm can be fixed at a door (8, 108) so as to be pivotable around a second setting axis (16, 116), and which comprises a setting contour (18, 118) around the first setting axis (13, 113), said setting contour (18, 118) being further biased by setting means (19, 119), a control arm (11, 111)

in which one end of the control arm can be fixed at a side wall (3, 103) of the cupboard body (1, 101) so as to be pivotable around a first control axis (14, 114) between an open position and a closed position, wherein the first control axis (14, 114) is arranged parallel to and at a distance from the first setting axis (13, 113), and in which the other end of the control arm can be fixed at a door (8, 108) so as to be pivotable around a second control axis (17, 117), wherein the second control axis (17, 117) is arranged parallel to and at a distance from the second setting axis (16, 116), wherein said setting contour (18, 118) is designed in the shape of a curve such that said setting arm (10, 110) is force-loaded by said setting means along at least a first part of its pivot path extending from an intermediate position, which is between the open position and the closed position along the pivot path, to the open position such that a torque is applied to the setting arm which is equivalent to a counter-torque introduced by the dead weight of the door in any position along said first part of the pivot path, wherein the door (8, 108) can be held in any position between the open position and the intermediate position by the torque which is applied to the setting arm.

2. A door setting device according to claim 1, wherein in the region of contact between the setting means (19, 119) and the setting contour (18, 118), the radial distance between the selling contour (18, 118) and the first setting axis (13, 113) decreases starting from an intermediate position of the setting arm (10, 110) towards the open position at least along the first part of the pivot path.

3. A door setting device according to claim 2, wherein, in the region of contact between the setting means (19, 119) and the setting contour (18, 118), the radial distance between the setting contour (18, 118) and the first setting axis (13, 113) increases towards the intermediate position along a second part of the pivot path, said second part of the pivot path extending from the intermediate position to the closed position.

4. A door setting device according to claim 2, wherein the selling means are provided in the form of a setting slide (19, 119) which setting slide (19, 119) is supported against the setting contour (18, 118) by means of a roller (20, 120) which is rotatably supported at the setting slide (19, 119).

5. A door setting device according to claim 2, wherein the setting means are provided in the form of a setting slide (19, 119) which setting slide (19, 119) is loaded against the setting contour (18, 118) by spring means (21, 121).

6. A door setting device according to claim 5 wherein there is provided a supporting bearing (24) which is held at a variable distance from the first setting axis (13, 113), and that the spring means (21, 121) are supported against the setting slide (19, 119) on the one hand and against the supporting bearing (24) on the other hand.

7. A door setting device according to claim 6, characterized in that the supporting bearing (24) is supported against a bearing face (25) of an abutment (26) which is rotatably supported around an axis of rotation (27), wherein, in the circumferential direction, the bearing face (25) comprises a variable distance from the axis of rotation (27).

8. A door setting device according to claim 7, characterized in that the bearing face (25) is worm-shaped.

9. A door setting device according to claim 1 wherein the door setting device comprises a housing (12, 112) which can be fixed to the side wall (3, 103) of the cupboard body (1, 101) and to which the setting arm (10, 110) can be fixed so as to be pivotable around the first setting axis (13, 113) and the control arm (11, 111) around the first control axis (14, 114).

10. A door setting device according to claim 1, wherein there is provided a fixing element (15, 115) to which the setting arm (10, 110) can be fixed so as to be pivotable around the second setting axis (16, 116) and the control arm (11,111) around the second control axis (17, 117), and which fixing element (15, 115) can be fixed to the door (8, 108).

11. A door setting device according to claim 1, wherein the distance between the first setting axis (13) and the first control axis ( 14) and the distance between the second setting axis (16) and the second control axis (17) are identical, and that the distance between the first setting axis (13) and the second setting axis (16) and the distance between the first control axis (14) and the second control axis (17) are identical.

* * * * *